US005821855A

United States Patent [19]

Lewis

[11] Patent Number: 5,821,855

[45] Date of Patent: Oct. 13, 1998

[54] RECOGNITION RESPONSIVE SECURITY SYSTEM

[76] Inventor: Tommy J. Lewis, 6313 NW. 63rd, No. 50, Oklahoma, Okla. 73132

[21] Appl. No.: 808,865

[22] Filed: Feb. 28, 1997

[51] Int. Cl.[6] ..... G08B 1/08

[52] U.S. Cl. ..... 340/539; 340/568; 340/572

[58] Field of Search ..... 340/539, 531, 340/522, 693, 500, 517, 521, 568, 571, 572, 573

[56] References Cited

U.S. PATENT DOCUMENTS

| | | | |
|---|---|---|---|
| 2,179,240 | 11/1939 | Breitenstein | 340/539 |
| 3,707,672 | 12/1972 | Miller et al. | 340/539 |
| 3,727,211 | 4/1973 | Guy | 340/539 |
| 4,484,183 | 11/1984 | Morey | 340/539 |
| 4,906,973 | 3/1990 | Karbowski et al. | 340/539 |
| 4,931,646 | 6/1990 | Koechner | 250/367 |
| 5,382,943 | 1/1995 | Tanaka | 340/539 |
| 5,448,220 | 9/1995 | Levy | 340/539 |

*Primary Examiner*—Jeffery A. Hofsass

*Assistant Examiner*—Daryl C. Pope

*Attorney, Agent, or Firm*—Terrance L. Siemens

[57] ABSTRACT

A security system for detecting weapons and explosives being carried into buildings and similar locations accessible to the public. A sensing unit is located at a monitored premises, and has at least two types of sensors. Each sensor senses a characteristic of weapons or explosives which is different from characteristics sensed by another sensor. The sensing unit transmits data signals by radio to a control station having a microprocessor for processing these data signals. Data from the sensing unit is compared to stored data relating to known, predetermined characteristics of weapons and explosives. If comparison determines recognition of a weapon or explosive or both at a monitored premises, an alarm ensues. Identification of the weapon or explosive is displayed on a CRT monitor and is printed out. Optionally, a distress signal is generated, and connected by a telephone system to a third party. Preferably, many sensing apparatuses at diverse premises communicate with a single control station. Personnel at the control station may control the control station by a hand held remote controller to respond to alarms and test sensing apparatuses.

16 Claims, 3 Drawing Sheets

RECOGNITION RESPONSIVE SECURITY SYSTEM

REFERENCE TO RELATED PATENT DOCUMENT

This application is related to Disclosure Document Number 355,023, filed May 25, 1994.

BACKGROUND OF THE INVENTION

1. Field of the Invention

The present invention relates to a security system for protecting a site accessible to large numbers of people, such as a building. More particularly, the invention relates to a security system for detecting agents of destruction, such as weapons and explosives, which may be carried by people entering the site, and for activating an appropriate alarm. A microprocessor is provided with memory and data stored in this memory relating to known characteristics of weapons and bombs. Upon detecting a potential weapon or bomb, data gleaned from detection apparatus is compared to data stored in memory. The results of this comparison are displayed on a visual monitor, initiate operation of an alarm, or both.

2. Description of the Prior Art

Security of buildings and sites is in part dependent upon preventing persons bent on damage from transporting agents of destruction into these buildings and sites. While it is not feasible to control possession and transport of weapons and bombs in an open and free society, it nonetheless becomes necessary at certain times and in certain places to prevent these agents of destruction from being carried into buildings and other sites. The best way of identifying the presence of agents of destruction is to detect their presence while they are being carried, even if concealed, and prior to the carrier deploying them. To this end, the prior art has suggested detectors and systems for detecting weapons and like objects.

U.S. Pat. No. 3,707,672, issued to Robert C. Miller et al. on Dec. 26, 1972, describes a weapons detector which senses the nature of a metallic object, as well as mere presence or absence thereof within the zone of detection, and compares sensed data to predetermined data characteristic of those objects which the system is designed to detect. An appropriate alarm is activated when sensed data significantly shares characteristics with the predetermined data. Unlike the present invention, the device of Miller et al. is entirely located at the monitored site. Hence, remote monitoring is not disclosed. Miller et al. also employs only one type of detector and lacks visual outputs or displays, unlike the present invention.

A security system shown in U.S. Pat. No. 4,484,183, issued to Gille M. Morey on Nov. 20, 1984, features radio communication between various components of the system. This feature eliminates necessity of hard wiring components together. However, no metal or explosive detecting probe is disclosed, and there is no memory for comparing characteristics of a sensed object with characteristics in memory. By contrast, the present invention incorporates these features, as well as visual outputs.

A walk-through metal detector described in U. S. Pat. No. 4,906,973, issued to James P. Karbowski et al. on Mar. 6, 1990, has features for determining characteristics of a metal object. This is an advance over mere detection of presence or absence of metal in an area being monitored. The metal detector also has the ability to disregard extraneous and unrelated inputs, such as large metal objects located near the monitored location, and false signals arising from vibrations unrelated to an object being monitored. However, Karbowski et al. lacks comparison capability, visual outputs, and remote monitoring of the present invention.

Another metal detector is described in U.S. Pat. No. 2,179,240, issued to Victor W. Breitenstein on Nov. 7, 1939. This device asserts ability to disregard stationary metal objects, while detecting moving metal objects. This feature would enable monitoring of a person passing through a monitored area, but would ignore false signals generated by irrelevant sources, such as metal structural elements of the protected building. Breitenstein lacks comparison capability, visual outputs, and remote monitoring of the present invention.

None of the above inventions and patents, taken either singly or in combination, is seen to describe the instant invention as claimed.

SUMMARY OF THE INVENTION

The present invention provides a security system which detects presence of personally carriable agents of destruction, such as handguns and explosives, and generates an alarm responsive to recognition of these agents when they pass an access point into a protected area. Recognition is accomplished by comparing data patterns obtained by detectors to predetermined characteristic weapon and explosive patterns maintained in electronic memory. When comparison yields a sufficient correlation, the alarm is activated.

Preferably, the invention is practiced in a form utilizing a single, centrally located control center having a microprocessor, and a plurality of sensing units located at diverse premises whose access is being monitored. The sensing units may be linked to the control component by radio or by telephone. Personnel located at the control center or anywhere remotely located from the sensing units may monitor conditions at the secured sites by a remote controller.

Recognition of an alarm condition may activate different responses. In some secured premises, a loud noise may be desired. Illustratively, if the object is to frighten an intruder, or to serve notice that a dangerous object in his or her possession is known to authorities, a siren or buzzer may be desired. In other secured premises, it may be desirable to summon assistance, such as police, family members or other authorized parties, or emergency personnel, such as fire or rescue personnel. In still other instances, the nature of the threat may be displayed on a cathode ray tube monitor or printed out for evaluation for determining an appropriate response. In any of these cases, it is possible to notify a third party by a predetermined telephone message, pager, or the like.

The present invention has sensors of diverse types for sensing the presence of handguns and of explosives. The sensors pass sensed data to a microprocessor for comparison against data stored in memory that correlates to known characteristics of weapons and explosives. Recognition occurs when the microprocessor determines a present level of correlation between weapon and explosive characteristics stored in memory and the data transmitted by sensors in the system.

Optionally, many types of outputs are provided at the control station, depending upon the nature of the monitored premises. A CRT screen displays messages relating to identified threats, such as a match generated by a comparison to known handguns or identification of an explosive. A printer may optionally print out displayed messages. In a further optional response, which may be preprogrammed into the microprocessor, a telephone call could be placed to a third party that would deliver a predetermined and prerecorded message.

Accordingly, it is a principal object of the invention to provide a security system which recognizes weapons and explosives by detecting characteristics and comparing data derived from these sensed characteristics to characteristic data stored in electronic memory.

It is another object of the invention to activate an alarm responsive to recognition of weapons and explosives.

It is a further object of the invention to centralize a control station having a microprocessor for storing characteristic data pertaining to weapons and explosives in memory and for comparing data derived from various remote sensing units and where the centralized control location has alarm and display apparatus.

Still another object of the invention is to provide a plurality of varied sensors at diverse premises being monitored, and to provide wireless communications for communicating the sensed data to the microprocessor located at the control station.

An additional object of the invention is to provide an apparatus for summoning assistance and transmitting an alarm message to a third party responsive to the recognition of sensed characteristics of weapons and explosives at the monitored premises.

It is again an object of the invention to enable personnel operating the security system to activate, monitor, and test the various sensors by a hand held, remote control apparatus.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
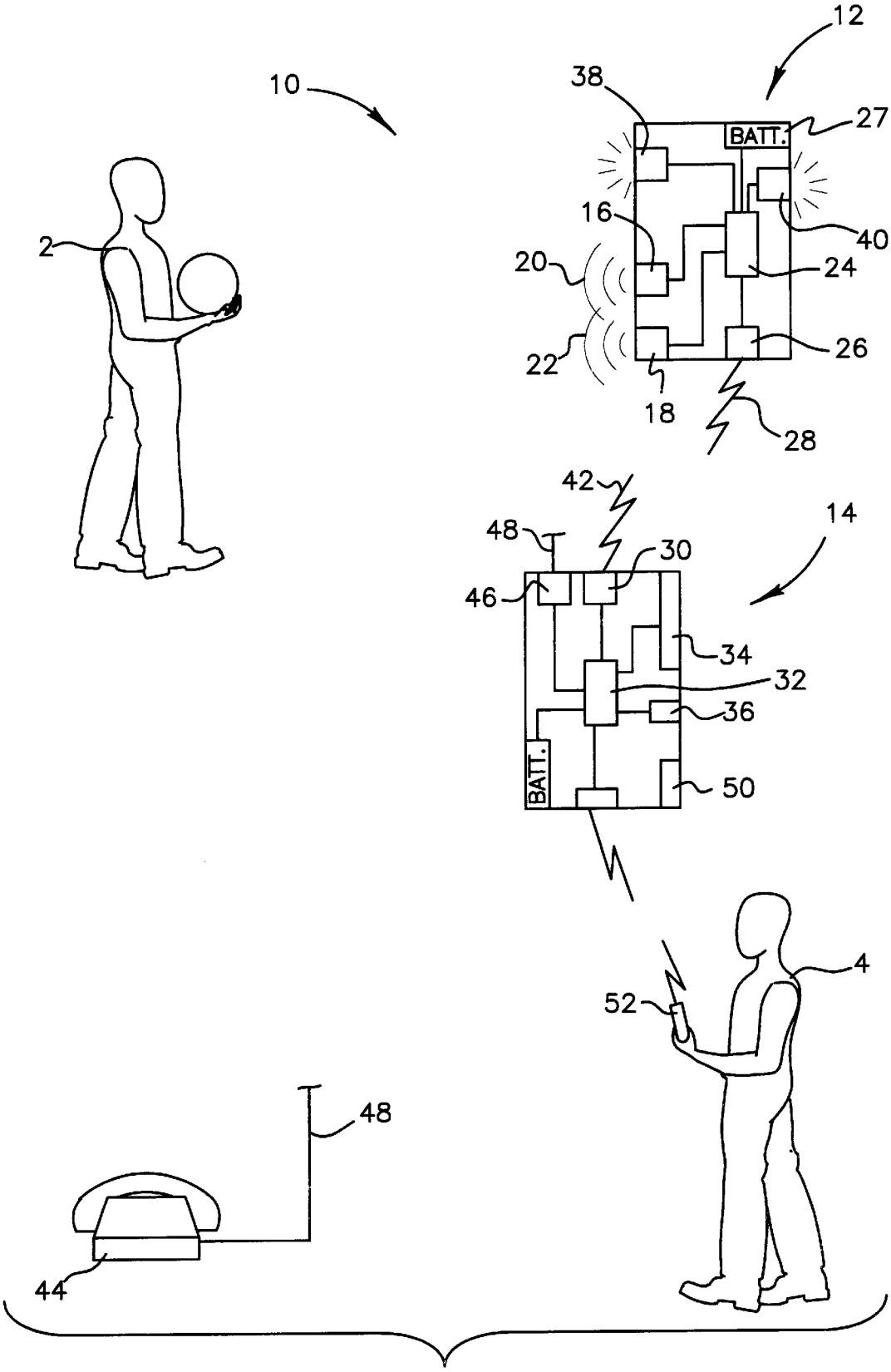
FIG. 1 is a diagrammatic representation of a simplified form of the invention, emphasizing structure and function of the invention.

Turning now to FIG. 1 of the drawings, the novel security system 10 is shown in its simplest form, having a sensing apparatus 12 and a control station 14. Sensing apparatus 12 is located on or about premises (not separately shown) being protected. This protection is provided by the sensing apparatus 12's detection of various agents of destruction, such as guns and explosives, carried by a person 2 entering the premises. Security system 10 detects and recognizes certain dangerous or objectionable objects (not shown), and alerts predetermined authorities (not shown), who may then react to the threat. Optionally, audible or visible alarms or both (described hereinafter) are incorporated into sensing apparatus 10. Control station 14 is remote from premises monitored by sensing apparatus 12, but remains in communication with sensing apparatus 12, as will presently be further explained.

Sensing apparatus 12 is a self-contained device enclosed within a housing (not shown) which is mounted at a selected location at the monitored premises which would be advantageous for subjecting persons 2 entering a monitored zone (not separately shown) to sensing. In a preferred embodiment, a supporting, protective enclosure (not shown) is permanently or temporarily mounted at an access point the premises, and sensing apparatus 12 could be lockably or outherwise yet removably installed within the protective enclosure. Alternatively, both the enclosure and sensing apparatus 12 could be permanently installed in a location.

Sensing apparatus 12 has a first sensor 16 and a second sensor 18. Sensors 16 and 18 are of suitable types for gathering data regarding the characteristics of metals or chemicals known to be employed in hand carried explosive devices or weapons. Each sensor 16 or 18 gathers data relating to different characteristics of these metals or chemicals. As an example, sensor 16 may be a metal detecting type described in U.S. Pat. No. 3,707,672, issued to Robert C. Miller et al. on Dec. 26, 1972, which patent is hereby incorporated by reference.

Sensor 18 may be any well known sensor which responds to the presence of a primary chemical or tagging agent mixed with explosives for identification purposes, or may be a sensor which responds to other characteristics of metals or explosives. Illustratively, sensor 18 may be an X-ray emitter and receiver for providing penetrating visual data relating to the disposition and dimensions of metallic or other hidden dense objects. Alternatively, sensor 18 may comprise a sonic or ultrasonic emitter and receiver which compares the change between the emitted signal and the received signal to measure or infer qualities of materials passing through or by the sensor 18. Essentially similar sensors are known, and are employed, for example, to detect C4 plastic explosive. Further detail of such sensors need not be set forth in greater detail.

Emitted signals, regardless of their actual nature, are diagrammatically shown at 20 and 22. Sensing apparatus 12 is located appropriately on the monitored premises such that signals 20 and 22 project throughout a predetermined zone. This zone may encompass an approach to a building, a doorway, a hall or corridor, or any other limited area through which a person 2 will predictably pass when entering the premises.

In the embodiment described herein, data is gathered by sensors 16 and 18. If it is desired to check for supplementary characteristics, additional sensors could be added to sensing apparatus 12 and transmitted to control station 14 for processing. Sensing apparatus 12 has a microprocessor 24 for converting raw data signals from sensors 16 and 18 into digital form or into any other suitable form for transmission. Microprocessor 24 activates a radio transmitter and receiver 26 to transmit usable data to control station 14.

Data is preferably transmitted to control station 14 by radio. For this purpose, as well as for reception of control commands, sensing apparatus 12 has a radio transmitter and receiver 26. Radio communication enables sensing apparatus 12 to avoid hard wired connection for communications. A battery 27 is located within sensing apparatus 12, so that sensing apparatus 12 has an independent source of power, and therefore does not rely upon external hard wiring (not shown) for power.

Transmitted data, indicated at 28, is received by a radio transmitter and receiver 30 associated with control station 14. Data is conducted to a microprocessor 32 in control station 14 for processing. Individual characteristics obtained from sensors 16 and 18 are compared to known, predetermined characteristics of materials and objects regarded as likely candidates to comprise an agent of destruction. Illustratively, many thousands of characteristics or profiles may be stored within microprocessor 32, and may be almost instantaneously compared with data transmitted from sensing apparatus 12.

When a predetermined number or quality of characteristics from incoming data match with those stored in memory, microprocessor 32 may be said to potentially recognize an object or substance. Recognition may occur at differing levels of certainty or correlation with stored data. Below this predetermined level of correlation or recognition, microprocessor 32 will not initiate an active response.

At levels of correlation or recognition above the predetermined threshold, microprocessor 32 initiates an alarm procedure. Microprocessor 32 automatically generates signals causing the results of the comparison and, optionally, messages recognizable to a human operator 4, to be displayed in visual form on a cathode ray tube monitor 34 and to be printed on a printer 36. Optionally, an alarm local to the monitored premises may be activated.

To this end, sensing apparatus 12 may include an audible alarm 38 or a visual alarm 40, or both. Alarms 38 and 40 are activated by command signals 42 generated by control station 14 responsive to the potential recognition of an agent of destruction transmitted by radio transmitter and receiver 30. Microprocessor 24 translates command signals 42 into signals activating alarms 38 and 40.

Another response to the potential recognition of an agent of destruction is to initiate a distress call for summoning assistance from a third party, shown representatively by telephone 44. The third party called may be emergency personnel, such as police or fire and medical personnel, or any predetermined, authorized party remote from control station 14. Control station 14 has automatic dialing apparatus 46 connected to a telephone system, represented by telephone line 48, for initiating a telephone call responsive to a command from microprocessor 32.

Control station 14 may be attended by human operator 4. Operator 4 may remain in close proximity to control station 14, or may alternatively move out of close proximity thereto. When in close proximity, operator 4 may enter various commands into security system 10 by employing a control panel 50. Control panel 50 has pushbuttons and keypad (see FIG. 2) for entering commands.

Alternatively, when operator 4 moves out of proximity to control panel 50, he or she may utilize a hand held, remote controller 52 (see FIG. 2) for responding to an alarm.

Figure 2:
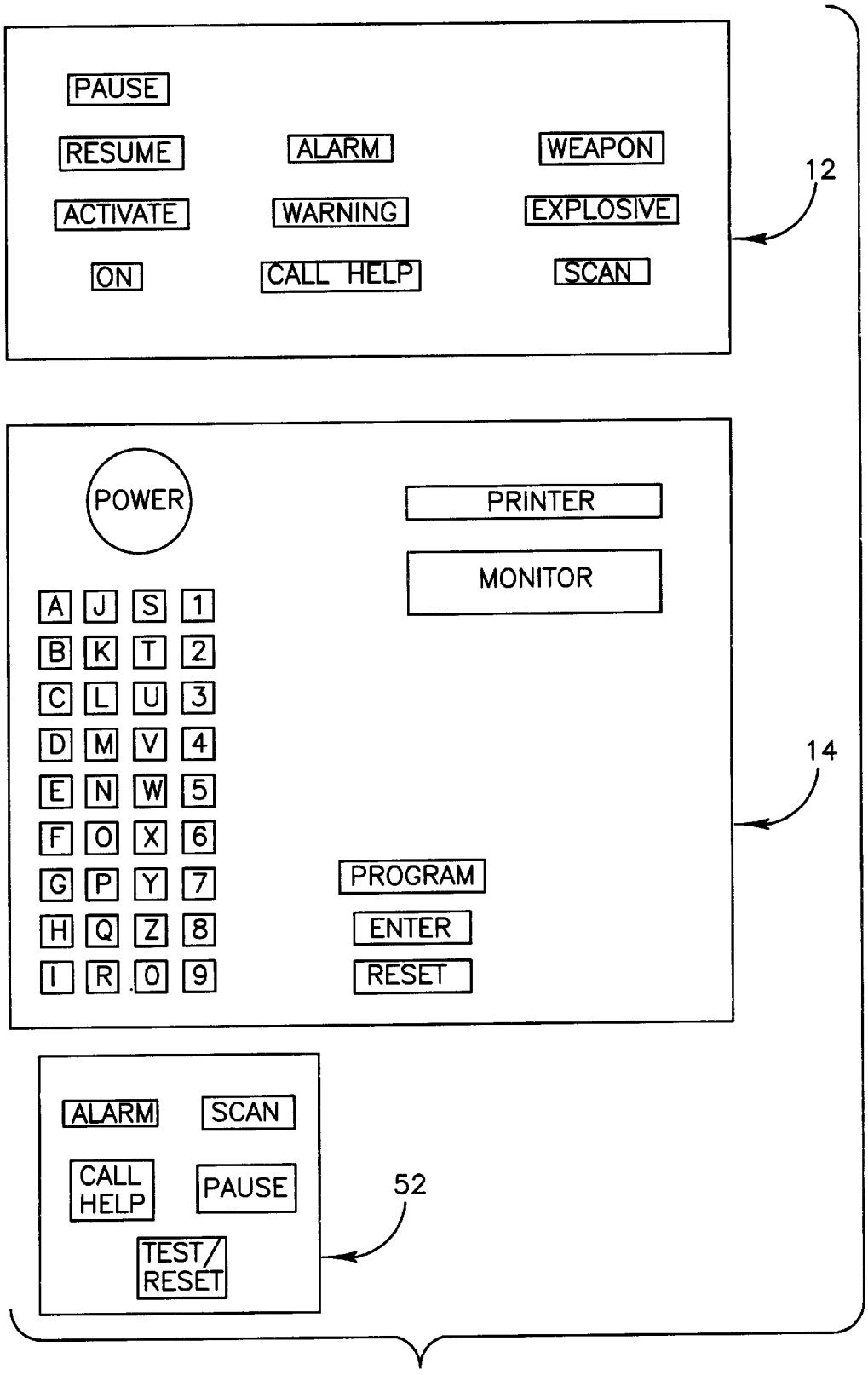
FIG. 2 is a diagrammatic view of the exteriors of the principal components of the invention.

FIG. 2 shows functions provided by the principal components of the invention. At the top of FIG. 2, a preferred embodiment of sensing apparatus 12 is shown. Control keys are connected to microprocessor 24 to initiate appropriate action responsive to each control key when depressed. A command key labeled "Pause" causes a temporary cessation of activity and transmissions. This key enables personnel at the premises to disarm sensing apparatus 12 temporarily while a potential threat is investigated. A key labeled "Resume" causes normal functions to resume. "On" is a main switch connecting power from battery 27 (see FIG. 1) to all power consuming components of sensing apparatus 12, while "Activate" is a switch activating sensors 16 and 18 (see FIG. 1).

An alarm 38 or 40, or both, may be controlled by a key labeled "Alarm". A key labeled "Call Help" will initiate a summons for assistance. This feature differs from an optional automatic summoning feature in that the keyed feature is manual, and recognition of a threat by microprocessor 32 is not required for activation.

Alarm conditions and status of sensing apparatus 12 is indicated by illuminated indicators. Indicators labeled "Weapon" and "Explosive" signal that microprocessor 32 at control station 14 has recognized these respective threats. An indicator labeled "Scan" indicates that sensors 16 and 18 are operative, although no potential threats have been detected. An indicator labeled "Warning" signals that a potential threat has been detected, but more precise information is not available.

Control station 14 has an alphanumeric key pad which enables entry of an identifying code for each one of many possible monitored premises, or of each individual sensing apparatus 12. A program key enables selection of a desired function, which will proceed when a key labeled "Enter" is depressed. A reset key clears microprocessor 32 for entry of new commands.

Remote controller 52 does not enable the full range of functions available at control panel 50, but does enable certain functions to be manually activated by operator 4 even if operator 4 is away from control panel 50. Remote controller 52 automatically responds to a sensing apparatus 12 which is signalling potential distress, and duplicates certain functions which may be initiated from controls mounted on sensing apparatus 12, as described above. In addition, remote controller 52 enables resetting of an active sensing apparatus 12.

Figure 3:
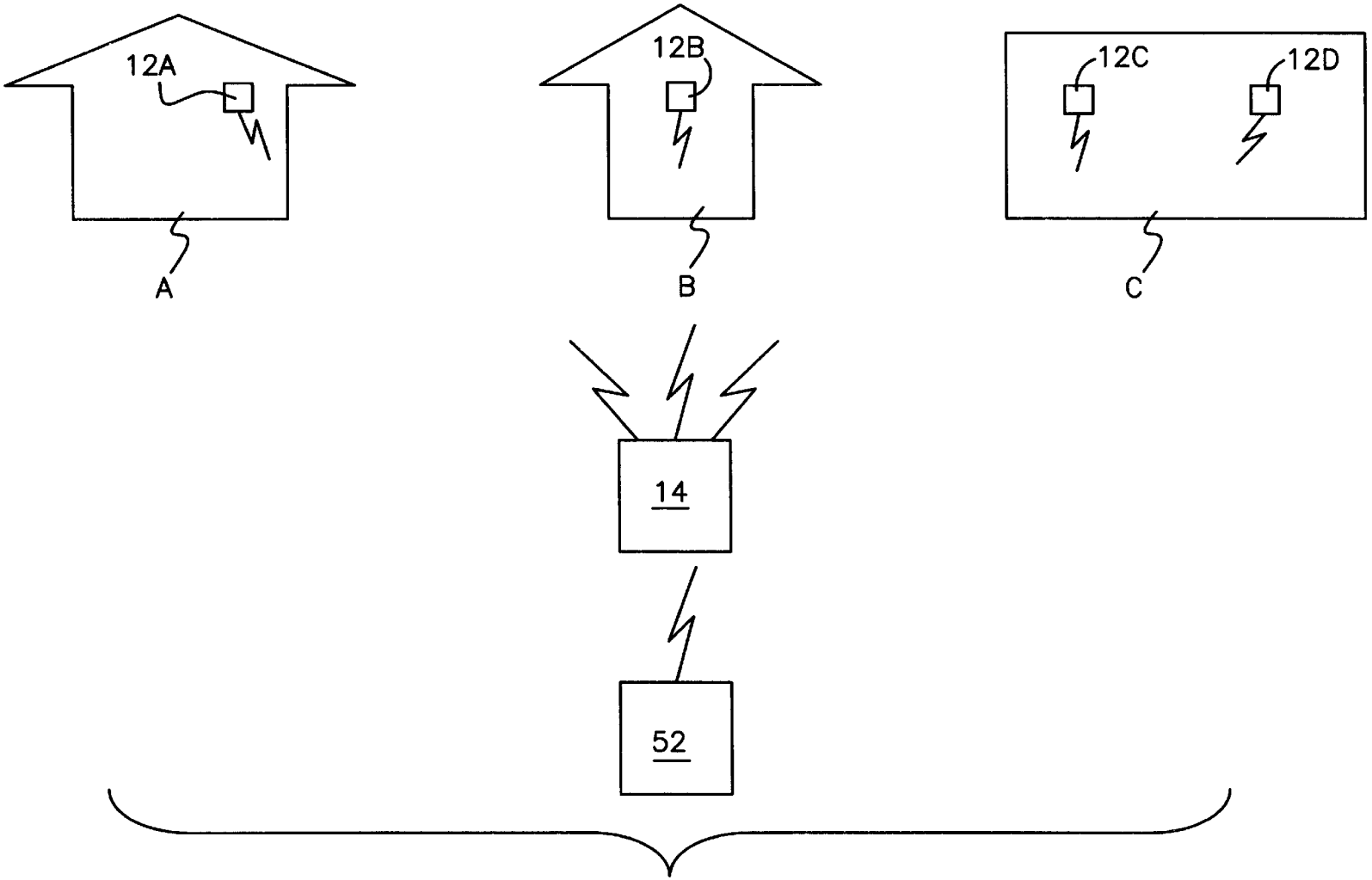
FIG. 3 is a diagrammatic representation of a preferred form of the invention, wherein many premises are monitored from a central location.

Turning now to FIG. 3, the invention is advantageously employed in the following way. Security system 10 includes one control station 14 and more than one sensing apparatus 12, thereby monitoring many premises for agents of destruction from a single control station. This is highly efficient, while still enabling rapid and effective response to an alarm condition.

In the example of FIG. 3, three premises A, B, and C are depicted. Relatively small premises, as represented by residences A and B, are each provided with one sensing apparatus 12A or 12B, although additional sensing apparatus (not shown) could be provided if desired. Relatively larger premises, as represented by C and illustratively including large stores or office buildings, are provided with several sensing apparatus 12C, 12D. Each sensing apparatus 12A, 12B, 12C, and 12D is capable of independent communication with control station 14 and indirectly with remote controller 52. Thus it is possible that a single party be charged with responsibility for monitoring many premises and portions thereof. A great economy of personnel is realized, since relatively few operators 4 (see FIG. 1) are required to perform monitoring.

Of course, sensing apparatus 12, control station 14, and remote controller 52 incorporate necessary components to accomplish functions set forth herein. These components are well known in the fields of electronic data handling and telecommunications, and will not be set forth in greater detail.

It will be appreciated that the embodiments of the invention as set forth herein are subject to many variations and modifications which may be introduced without departing from the spirit of the invention. The invention comprises a combination of individually known components assembled to realize the functions and constructions set forth herein, rather than comprising novel components and hardware per se.

It is to be understood that the present invention is not limited to the embodiments described above, but encompasses any and all embodiments within the scope of the following claims.

I claim:

1. A security system for the detection of an agent of destruction within an access area of a predetermined location, said security system comprising:

a sensing apparatus proximate the access area including a sensing means independent internal power source, said sensing apparatus also including;

a first sensor means for detecting a first predetermined characteristic of an agent of destruction, said first sensor means being able to generate a first data signal indicative of said first predetermined characteristic; and where said sensing apparatus also includes a second sensor means for detecting a second predetermined characteristic of an agent of destruction, said second sensor means being able to generate a second data signal indicative of said second predetermined characteristic of an agent of destruction; said sensing apparatus also including data transmission means for transmitting said first and said second data signals;

a control station, said control station including control station independent internal power source;

receiving means for receiving said first and said second data signals from said data transmission means;

a microprocessor including storage means for storing prerecorded data signals corresponding to known characteristics of agents of destruction, said microprocessor also including comparison means for comparing said first and said second data signals received by said receiving means with said prerecorded data signals corresponding to known characteristics of the agents of destruction; and a display generation means for displaying a message responsive to the comparison between said first and said second data signals and said prerecorded data signals corresponding to known characteristics of the agents of destruction; whereby said first and said second sensor means monitor the access area at the predetermined location and when a first or a second predetermined characteristic of an agent of destruction is detected, said data transmission means transmits said first or said second data signal indicative of said detected first or second predetermined characteristic and said comparison means compares said first or said second data signal with said prerecorded data signals and said display generation means displays a message responsive to the comparison.

2. The security apparatus according to claim 1, wherein said data transmission means of said sensing apparatus and said receiving means of said control station both comprise radio transmitter/receivers; whereby said sensing apparatus may be located remotely from said control station.

3. The security system according to claim 2, wherein there exists a plurality of said sensing apparatus such that more than one access to a predetermined location may be monitored.

4. The security system according to claim 3, further comprising a hand held remote controller for remotely controlling said control station by a person beyond reach of said control station.

5. The security system according to claim 2, wherein said control station further includes summoning means for automatically generating calls for assistance from emergency personnel, said summoning means further including means for automatic dialing, connection means for connecting said summoning means to a telephone system, and means for transmitting a predetermined distress message across the telephone system.

6. The security system according to claim 2, wherein said display generation means further includes a cathode ray tube monitor and a printer, and said display generation means further includes means for both displaying and printing a message responsive to the comparison between said first and said second data signals and said prerecorded data signals in said control station.

7. The security system according to claim 2, wherein said sensing apparatus includes an audible alarm and said control station further includes a command signal generator connected to said radio transmitter/receiver of said control station receiving means, said command signal generator being capable of activating said audible alarm in response to the comparison of said first and said second data signal with said prerecorded data signals.

8. The security system according to claim 2, wherein said sensing apparatus includes a visual alarm and said control station further includes a command signal generator connected to said radio transmitter/receiver of said control station receiving means, said command signal generator being capable of activating said visual alarm in response to the comparison of said first and said second data signal with said prerecorded data signals.

9. A security system for the detection of an agent of destruction within an access area of a predetermined location, said security system comprising:

a sensing apparatus proximate the access area including a sensing means independent internal power source, said sensing apparatus also including;

a first metal detecting sensor means for detecting indications of the presence of metal indicative of the presence of an agent of destruction, said first metal detecting sensor means being able to generate a first data signal indicative of the presence of metal; and where said sensing apparatus also includes;

a second sensor means for detecting a second predetermined characteristic of an agent of destruction, said second sensor means being able to generate a second data signal indicative of said second predetermined characteristic of an agent of destruction; said sensing apparatus also including data transmission means for transmitting said first and said second data signals;

a control station, said control station including a control station independent internal power source;

a receiving means for receiving said first and said second data signals from said data transmission means;

a microprocessor including storage means for storing prerecorded data signals corresponding to known characteristics of agents of destruction, said microprocessor also including comparison means for comparing both said first data signal indicative of the presence of metal and said second data signal indicative of said second predetermined characteristic of an agent of destruction received by said receiving means with said prerecorded data signals corresponding to known characteristics of the agents of destruction; and a display generation means for displaying a message responsive to the comparison between said first and said second data signals and said prerecorded data signals corresponding to known characteristics of the agents of destruction; whereby said first and said second sensor means monitor the access area at the predetermined location and when said first data signal indicative of the presence of metal or said second data signal indicative of said second predetermined characteristic of an agent of destruction is detected, said data transmission means transmits said first or said second data signal indicative of said detected first or second predetermined characteristic and said comparison means compares said first or said second data signal with said prerecorded data signals and said display generation means displays a message responsive to the comparison.

10. The security apparatus according to claim 9, wherein said data transmission means of said sensing apparatus and said receiving means of said control station both comprise radio transmitter/receivers; whereby said sensing apparatus may be located remotely from said control station.

11. The security system according to claim 10, wherein there exists a plurality of said sensing apparatus such that more than one access to a predetermined location may be monitored.

12. The security system according to claim 11, further comprising a hand held remote controller for remotely controlling said control station by a person beyond reach of said control station.

13. The security system according to claim 10, wherein said control station further includes summoning means for automatically generating calls for assistance from emergency personnel, said summoning means further including means for automatic dialing, connection means for connecting said summoning means to a telephone system, and means for transmitting a predetermined distress message across the telephone system.

14. The security system according to claim 10, wherein said display generation means further includes a cathode ray tube monitor and a printer, and said display generation means further includes means for both displaying and printing a message responsive to the comparison between said first and said second data signals and said prerecorded data signals in said control station.

15. The security system according to claim 10, wherein said sensing apparatus includes an audible alarm and said control station further includes command signal generator connected to said radio transmitter/receiver of said control station receiving means, said command signal generator being capable of activating said audible alarm in response to the comparison of said first and said second data signal with said prerecorded data signals.

16. The security system according to claim 10, wherein said sensing apparatus includes a visual alarm and said control station further includes command signal generator connected to said radio transmitter/receiver of said control station receiving means, said command signal generator being capable of activating said visual alarm in response to the comparison of said first and said second data signal with said prerecorded data signals.

* * * * *